US009115548B2

(12) United States Patent
Angelle et al.

(10) Patent No.: US 9,115,548 B2
(45) **Date of Patent: *Aug. 25, 2015**

(54) LARGE DIAMETER TUBULAR LIFTING APPARATUSES AND METHODS

(71) Applicant: Frank's International, LLC, Houston, TX (US)

(72) Inventors: Jeremy Richard Angelle, Youngsville, LA (US); Logan Essex Smith, Youngsville, LA (US)

(73) Assignee: Frank's International, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/790,490

(22) Filed: Mar. 8, 2013

(65) Prior Publication Data

US 2013/0186643 A1 Jul. 25, 2013

Related U.S. Application Data

(63) Continuation of application No. 12/819,703, filed on Jun. 21, 2010.

(60) Provisional application No. 61/219,328, filed on Jun. 22, 2009.

(51) Int. Cl.

| | |
|---|---|
| ***E21B 19/07*** | (2006.01) |
| ***E21B 19/15*** | (2006.01) |
| ***B66C 1/12*** | (2006.01) |

(52) U.S. Cl.

CPC ..... *E21B 19/155* (2013.01); *B66C 1/12* (2013.01); *E21B 19/07* (2013.01)

(58) Field of Classification Search

CPC ..... E21B 19/155; E21B 19/07
USPC ..... 166/77.51, 77.52, 77.53, 380, 381; 175/85; 294/67.31, 81.61, 102.2, 198, 294/201; 414/22.52, 22.54, 22.58, 22.62
See application file for complete search history.

(56) References Cited

U.S. PATENT DOCUMENTS

| | | | |
|---|---|---|---|
| 1,433,624 | A | 10/1922 | Johnston |
| 1,475,146 | A | 11/1923 | Septer |
| 2,442,249 | A | 5/1948 | Schultz |

(Continued)

FOREIGN PATENT DOCUMENTS

WO WO 2005106185 A1 * 11/2005

OTHER PUBLICATIONS

Office Action issued in U.S. Appl. No. 12/819,703, mailed on May 3, 2013 (17 pages).

(Continued)

*Primary Examiner* — Giovanna C Wright
*Assistant Examiner* — Richard Alker
(74) *Attorney, Agent, or Firm* — Osha Liang LLP

(57) ABSTRACT

A method to add a joint of pipe to a conductor string includes securing the conductor string with a spider, grasping an upper end of the joint of pipe with a segmented-ring elevator, engaging a plurality of slips of the elevator with an outer profile of the joint of pipe, raising the grasped joint of pipe from non-vertical to vertical, positioning the vertical joint of pipe atop the secured conductor string, attaching the joint of pipe to the conductor string, releasing the conductor string from the spider, and retaining the joint of pipe and the conductor string with the segmented-ring elevator.

11 Claims, 7 Drawing Sheets

(56) References Cited

U.S. PATENT DOCUMENTS

| | | | | | |
|---|---|---|---|---|---|
| 3,675,278 | A | * | 7/1972 | Powell | 294/102.2 |
| 4,098,532 | A | | 7/1978 | Phillips | |
| 4,269,554 | A | * | 5/1981 | Jackson | 414/22.63 |
| 4,792,172 | A | * | 12/1988 | Montanari et al. | 294/102.2 |
| 4,823,919 | A | * | 4/1989 | Hayatdavoudi | 188/67 |
| 5,340,182 | A | * | 8/1994 | Busink et al. | 294/199 |
| 5,848,647 | A | | 12/1998 | Webre et al. | |
| 5,992,801 | A | | 11/1999 | Torres | |
| 7,178,626 | B2 | | 2/2007 | Matherne et al. | |

OTHER PUBLICATIONS

Office Action issued in related U.S. Appl. No. 12/819,703 dated Apr. 16, 2014 (15 pages).

* cited by examiner

LARGE DIAMETER TUBULAR LIFTING APPARATUSES AND METHODS

CROSS-REFERENCE TO RELATED APPLICATIONS

The present application is a continuation of, and therefore claims benefit under 35 U.S.C. §120 to, U.S. Patent Application No. 12/819,703, filed on Jun. 21, 2010, which claims benefit to U.S. Provisional Patent Application No. 61/219,328, filed on Jun. 22, 2009. These priority applications are hereby incorporated by reference in their entirety herein.

BACKGROUND OF THE DISCLOSURE

1. Field of the Disclosure

The present disclosure relates to apparatuses and methods to lift and install large-diameter tubulars with a drilling rig. More particularly, the present disclosure relates to apparatuses and methods to raise horizontal sections of large-diameter pipe to mount them atop vertical strings of large-diameter pipe. More particularly still, the present disclosure relates to apparatuses and methods to raise horizontal sections of conductor pipe to install them atop vertical strings of conductor pipe extending into a wellbore.

2. Description of the Related Art

Referring to FIG. 11, a perspective view is shown of a drilling rig 50 used to run tubular members 52 (e.g., casing, drill pipe, etc.) downhole into a wellbore. As shown, drilling rig 50 includes a frame structure known as a "derrick" 54 from which a traveling block 56 and an elevator 58 and/or a top drive (not shown) may be used to manipulate (e.g., raise, lower, rotate, hold, etc.) tubular members 52. As shown, traveling block 56 is a device that is located at or near the top of derrick 54, in which traveling block 56 may move up-and-down (i.e., vertically as depicted) to raise or lower tubular members 52. As shown, traveling block may be a simple "pulley-style" block and may have a hook 60 from which objects below (e.g., elevator 58) may be hung. Additionally, elevator 58 may also be coupled below traveling block 56 and/or a top drive (not shown) to selectively grab or release tubular members 52 as they are to be raised or lowered within and from derrick 54. Typically, elevator 58 includes movable gripping components (e.g., slips) movable between an open position and a closed position (shown in FIG. 11). In the closed position, the movable components form a load bearing ring (or shoulder) about or upon which tubular members 52 may bear and be lifted. In the open position, the movable components of elevator 58 may move away from one another to allow the tubular members 52 to be brought within or removed from elevator 58.

When assembling a string of tubular members 52 together, the tubular members 52 may be removed from a pipe rack 62 and pulled, or otherwise transported, towards an access opening 64, for example, a v-door, within the derrick 54 of the drilling rig 50. The tubular members 52 may be loaded onto a pipe ramp 66 adjacent to the access opening 64, in which a rigidly mounted end stop 68 may abut the ends of the tubular members 52 to support the tubular members 52 up against access opening 64.

Tubular-shaped goods have a variety of uses in oilfield operations including, but not limited to, drill pipe, drill collars, casing, continuous coiled tubing, and the like. One such tubular-shaped good used in exploration and drilling is conductor pipe. Generally, conductor pipe (e.g., drive pipe) is large-diameter pipe (e.g., between about 75 cm to about 100 cm or about 50 cm to about 182 cm in diameter), usually constructed of steel, that extends from the wellhead into the earth or ocean floor. As such, a string of conductor pipe sections (i.e., a conductor string) is typically the first string of "casing" run into the wellbore, and serves to stabilize the sediment surrounding the wellbore to prevent it from caving-in.

Installation of the conductor string may be performed any number of ways. On land, the conductor string may be driven into the ground from above with an impact loading hammer apparatus. In certain locations, excavation may be necessary prior to driving the conductor string into the uncovered sediment. Offshore, conductor strings may similarly be installed, using impact driving and excavation techniques. In undersea environments, conductor strings may be "jetted in", for example with a pressurized fluid discharged (e.g., seawater) at a distal end of the conductor string displacing the sediment as the conductor string is advanced into the sea floor. Following such a jetting process, an impact driving process may be performed to force the conductor string further into the sea floor, if desired. Additionally or alternatively, in undersea environments, conductor strings may be "sucked" into the sea floor by filling the string with water, sealing the conductor string, and then pumping, or evacuating, the trapped water from the inner bore of the conductor string. As the water is removed from the sealed bore of the conductor string, the conductor is plunged deeper into the sea floor as the sea floor sediment replaces the evacuated water. Following such a suction process, an impact driving process may be performed to force the conductor string further into the sea floor, if desired. Alternatively, impact driving may be performed simultaneously as the conductor string is jetted or sucked into the sea floor.

While conductor strings are relatively the largest (diameter) and shortest (length) strings of casing used to case a wellbore, the strings are still long enough to be assembled from several sections, or joints, of conductor pipe. As such, because of their large diameter and desired permanent placement about the wellbore, conductor strings are typically assembled, on site, from several joints of conductor pipe 20-40 feet long, and may be threaded or welded together end-to-end.

Historically, assembling strings of conductor pipe on the rig floor has been a difficult and time-consuming process. In one example method, to install a new joint of conductor pipe atop a string conductor pipe already engaged into the wellbore, a series of lifting eyes and handling eyes are affixed to the outer periphery of the large diameter and heavy-walled joint of conductor pipe to be added. In particular, a pair of heavy-duty lifting eyes are attached, typically 180° apart near the upper-most end of conductor pipe while it remains horizontal, either in the pipe rack or in another location on or near the drilling rig. Next, at least one pair of handling eyes are added to the joint of conductor pipe to be added, typically at opposite ends of the joint, but at similar radial positions.

As such, using various rigging and sling mechanisms, a crane may secure the bottom end of the horizontal conductor pipe (from a handling eye) while another crane (or the rig draw works) raises the upper end so that the formerly horizontal joint of conductor pipe may be held in a vertical position. Once moved into place atop the string of conductor pipe already engaged into the wellbore (and held in location by its lifting eyes), the joint of conductor pipe to be added may be threaded together and/or welded in place. With the new joint of conductor pipe attached, the lifting eyes of the former topmost joint may be removed and the entire string of conductor pipe may be supported and lowered by the lifting eyes affixed to the outer profile of the newly-added joint. Once the string of conductor pipe is supported by the lifting eyes of the new joint, the handling eyes of the new joint are removed, e.g., to minimize resistance in running the conductor string into the wellbore.

However, the installation and removal of the lifting and handling eyes may be problematic in itself. In many cases, bosses, pre-fabricated with the joint of conductor pipe, contain tapped holes to receive the lifting and handling eyes so that high-strength bolts may be used to transfer the load from the eyes to the joint of conductor pipe. Bosses are typically an external protrusion on the outer surface of the conductor pipe. When it comes time to remove the lifting and handling eyes, the bolts may be removed, however the boss remains. As a machining and welding process, the installation and manufacture of the bosses is both time consuming and expensive. Further, as an upset on the outer profile of the joint of conductor pipe, the bosses may add undesired resistance as the conductor string is driven further into the ground about the proposed wellbore and/or may prevent the sediment from re-settling around the conductor string, e.g., not allowing the sediment to sufficiently retain the conductor string in place. As the bosses are typically welded on and bolted to the lifting and handling eyes, they represent possible failure mechanisms that may disrupt operations should a boss, bolt, or lifting eye fail during the installation procedure.

Alternatively, lifting and handling eyes may be directly welded to the outer profile of the joints of conductor pipe. Following use, the welds may be ground off and the outer profile of the conductor pipe may be ground smoother such that little or no resistance to being driven remains. However, depending on regulations for the particular location, "hot work" such as welding and grinding may not be allowed to be performed at particular times on the rig floor. Additionally, the processes to weld, remove, and grind smooth the outer profiles of the joints of conductor pipe may represent a tremendous amount of time investment. Furthermore, during the removal and grinding process, there is opportunity for the outer profile of the joint of conductor pipe to become damaged to the point where it must be replaced or repaired. Repairing a lower joint of conductor pipe following the installation of an upper joint of conductor pipe would be highly undesirable, and would consume tremendous amounts of time and rig resources.

Apparatuses and methods to simplify the lifting, assembly, and installation of strings of conductor pipe would be well received in the industry. In particular, apparatuses and methods to assemble and install joints of conductor casing without requiring the installation and removal of lifting and handling eyes would be a significant benefit to the industry.

SUMMARY OF THE CLAIMED SUBJECT MATTER

In one aspect, the present disclosure relates to a method to add a joint of pipe to a conductor string including securing the conductor string with a spider, grasping an upper end of the joint of pipe with a segmented-ring elevator, engaging a plurality of slips of the elevator with an outer profile of the joint of pipe, raising the grasped joint of pipe from non-vertical to vertical, positioning the vertical joint of pipe atop the secured conductor string, attaching the joint of pipe to the conductor string, releasing the conductor string from the spider, and retaining the joint of pipe and the conductor string with the segmented-ring elevator.

In another aspect, the present disclosure relates to a lifting elevator including a first elevator segment, a second elevator segment, at least one pivot about which at least one of the elevator segment of the lifting elevator may rotate with respect to each other, a latch connecting the first elevator segment to the second elevator segment, and a plurality of slips to engage a conductor string surrounded by the first and second elevator segments.

In another aspect, the present disclosure relates to an apparatus to lift non-vertical pipe sections including a first lifting ring connected to a lifting point through a first lifting line, a second lifting ring connected to the lifting point through a second lifting line, and an inner profile of the first and second lifting rings configured to receive and secure a joint of horizontal pipe.

In another aspect, the present disclosure relates to a method to install a joint of conductor pipe to a conductor string including raising the joint of conductor pipe from a non-vertical position with a lifting apparatus, engaging a segmented ring elevator about the raised non-vertical joint of conductor pipe, closing the segmented ring elevator about the raised non-vertical joint of conductor pipe, activating at least one powered slip of the segmented ring elevator to grip the joint of conductor pipe, raising the segmented ring elevator until the joint of conductor pipe is in a vertical position, positioning the joint of conductor pipe atop the conductor string, and connecting the joint of conductor pipe to the conductor string.

BRIEF DESCRIPTION OF DRAWINGS

Features of the present disclosure will become more apparent from the following description in conjunction with the accompanying drawings.

DETAILED DESCRIPTION

Apparatuses and methods disclosed herein relate to the assembly and installation of strings of large-diameter tubulars. While strings of conductor pipe are discussed in conjunction with the embodiments described below, it should be understood that various types (and sizes) of tubular items may be handled, assembled, and installed in accordance with the embodiments described below.

Figure 1:
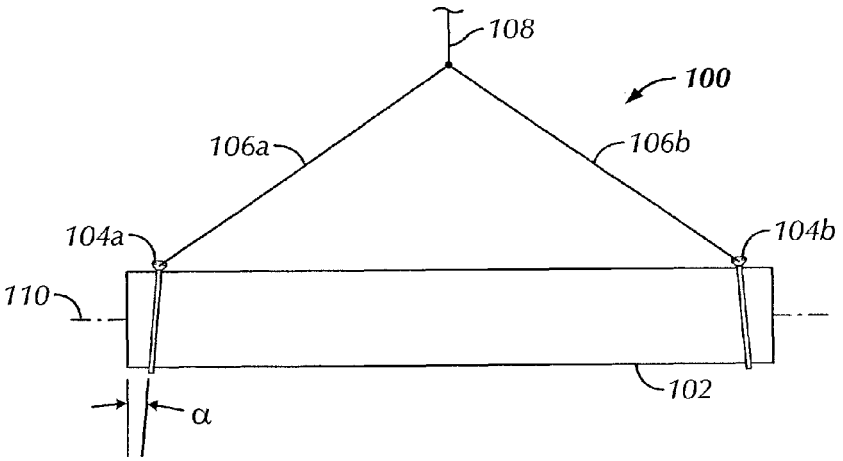
FIG. 1 is a schematic view drawing of a horizontal lifting apparatus in accordance with embodiments of the present disclosure.

Referring initially to FIG. 1, a horizontal lifting apparatus 100 is shown schematically lifting a horizontally-stored joint of conductor pipe 102. As shown, lifting apparatus 100 includes a pair of lifting rings 104A and 104B extending from a pair of lifting lines 106A and 106B to a single lifting point 108. As shown, lifting lines 106A, 106B may be of equal length so that when rings 104A, 104B are positioned at equal distances from ends of conductor pipe 102, vertical lifting at point 108 will result in a horizontal lift of joint of conductor pipe 102. However, in certain circumstances, it may be advantageous to lift joint of conductor pipe 102 at an angle, so those having ordinary skill in the art will appreciate that the relative positions of lifting rings 104A, 104B and lengths of lifting lines 106A, 106B may be varied to achieve the desired angle of joint of conductor pipe 102 as it is lifted.

Further, it should be understood that lifting rings 104A, 104B may be constructed as continuous circular (or other) profiles such that they are simply slid over the ends of conductor pipe 102 and moved into position. Similarly, the internal profiles of lifting rings 104A, 104B may comprise friction elements to prevent conductor pipe 102 from sliding out of the grasp of rings 104A, 104B during lifting operations. As such, the inner profiles of lifting rings 104A, 104B may comprise rubber or hardened metal dies to prevent undesired movement of conductor pipe 102 relative thereto. Furthermore, as shown in FIG. 1, when lines 106A, 106B are pulled at point 108, lifting rings 104A, 104B may be tilted with respect to an axis 110 of the joint of conductor pipe 102 at an angle $\alpha$. As such, lifting rings 104A, 104B may be constructed such that enough diametrical slack exists relative to the outer profile of joint of conductor pipe 102 that lifting rings 104A, 104B may "bite" into the conductor pipe 102 to more securely retain it.

Additionally, lifting rings 104A, 104B may be constructed as hinged and segmented rings such that they may be opened and closed laterally around the joint of conductor pipe 102 without needing to be slid over the ends. In particular, in cases where joints of conductor pipe 102 are laying directly on the floor of the rig or in the pipe rack, it may not be possible to slide rings 104A, 104B over the ends of layed pipe without lifting the conductor pipe 102 a sufficient amount to allow the thickness of lifting rings 104A, 104B thereunder. As such, segmented, openable, and closeable lifting rings 104A, 104B may allow the joint of conductor pipe 102 to be "grabbed" from above and lifted. Furthermore, the mechanisms of lifting rings 104A, 104B may be such that the segments of each ring 104A, 104B are tended to be closed as tension from lines 106A, 106B increases. Thus, for a joint of conductor pipe 102 laying on the floor, lifting rings 104A and 104B may be hingedly placed around the joint of pipe 102, but may not be able to fully close with pipe 102 laying on the floor. As lines 106A, 106B are pulled from point 108, rings 104A, 104B may be pulled fully closed as pipe 102 is lifted from the floor.

Finally, while lifting lines 106A, 106B and lifting point 108 are shown schematically, it should be understood that various lifting methods and apparatus, for example, but not limited to, lifting slings, chains, and other rigging may be used in place of the simple schematic view shown in FIG. 1. Furthermore, depending on location and the resources available, the horizontal lifting of joint of conductor pipe 102 from a pipe rack or the rig floor and next to be run may be performed by an auxiliary crane, a separate lifting apparatus, or by the drilling rig's draw works. After a "to be added" joint of conductor pipe 102 is disposed from its position in the pipe rack (or other location on the rig), it must be rotated to vertical before it may be assembled to the remainder of the string of conductor pipe 112.

Figure 2:
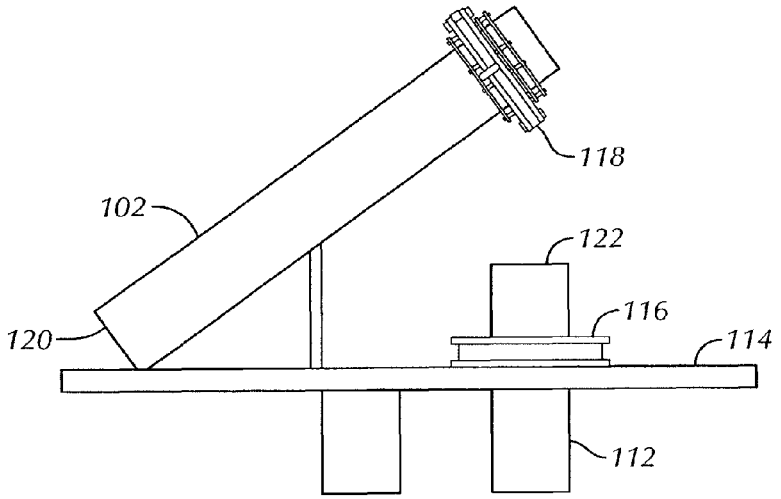
FIG. 2 is a schematic view drawing of a joint of conductor pipe being raised from a horizontal position to a vertical position in accordance with embodiments of the present disclosure.
Figure 3:
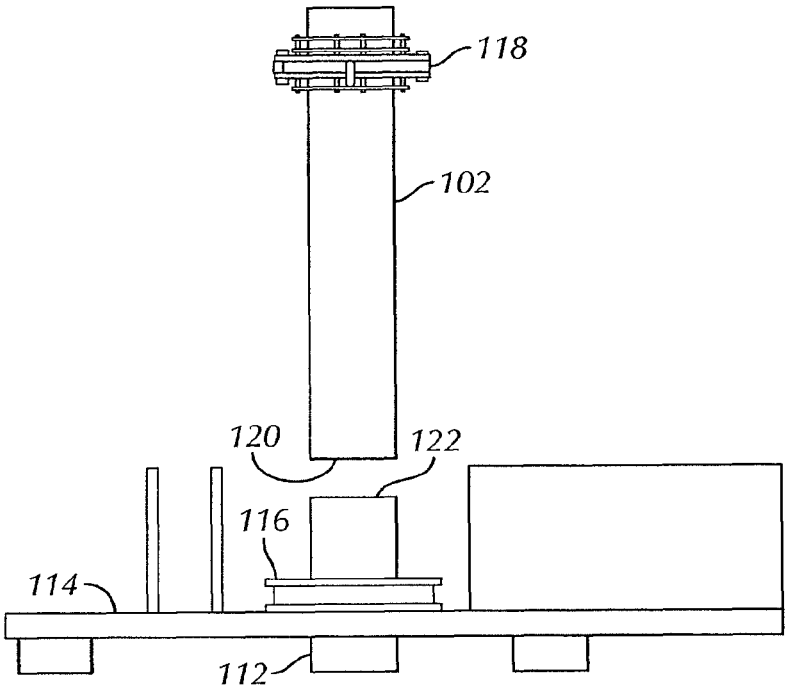
FIG. 3 is a schematic view drawing of the joint of conductor pipe of FIG. 2 in the vertical position in accordance with embodiments of the present disclosure.

Referring now to FIGS. 2 and 3, the rotation and assembly of joint of conductor pipe 102 to the remainder of a string of conductor pipe 112 is shown schematically. As depicted, the drilling rig includes a rig floor 114 and a spider 116 holding string of conductor pipe 112 in the well. A segmented elevator 118 grasps a first end of the joint of conductor pipe 102 to be added to string 112, such that joint of conductor pipe 102 may be tilted from a non-vertical position, e.g., the horizontal position in FIG. 1, or an intermediate position, e.g., as shown in FIG. 2, and to a vertical (FIG. 3) position. As will be described below in further detail, elevator 118 includes slips to grip the outer profile of joint of conductor pipe 102 and lifting lugs to allow elevator 118 to be lifted from a horizontal position to a vertical position so that lower end 120 of joint of conductor pipe 102 may be connected (e.g., threaded, welded, etc.) to the upper end 122 of the string of conductor pipe 112.

Figure 4:
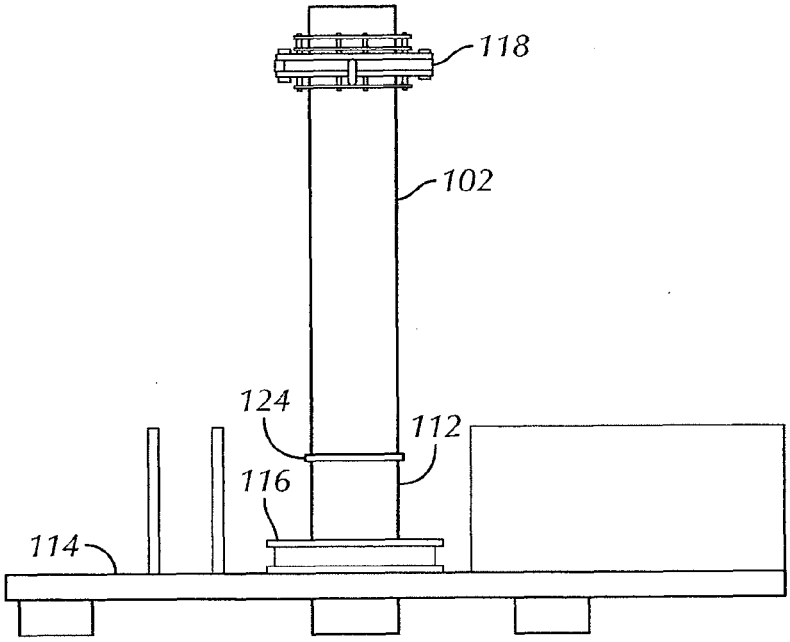
FIG. 4 is a schematic view drawing of the joint of conductor pipe of FIGS. 2 and 3 being connected to a string of conductor pipe in accordance with embodiments of the present disclosure.

Referring now to FIG. 4 the joint of conductor pipe 102 to be added is shown atop string of conductor pipe 112 where it may be connected in place at 124. Prior to completion of the welding, spider 116 supports the weight of pipe string 112 and elevator 118 supports the weight of joint of conductor pipe 102. With joint 102 securely connected to (and now integrally part of) conductor pipe string 112, the slips of spider 116 may be released so that the entire weight of the conductor pipe string 112 (including add on joint 102) may be carried by elevator 118.

Figure 5:
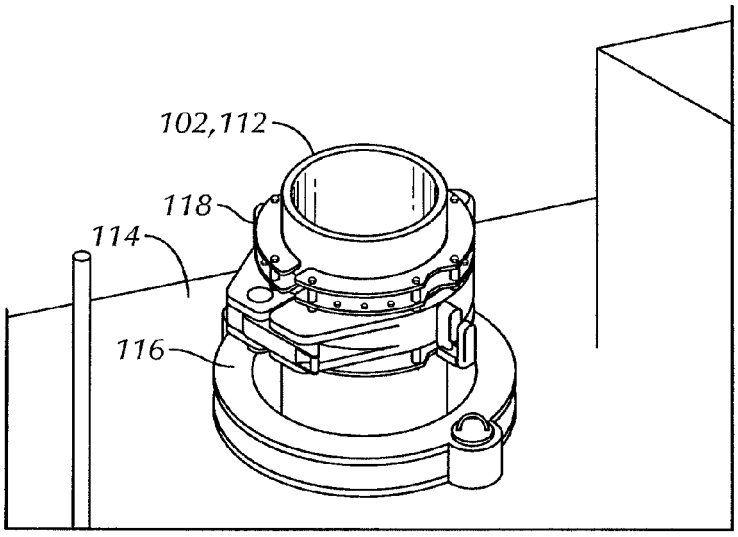
FIG. 5 is a schematic view drawing of the joint of conductor pipe of FIGS. 2-4 engaged into the wellbore along with the string of conductor pipe in accordance with embodiments of the present disclosure.
Figure 6:
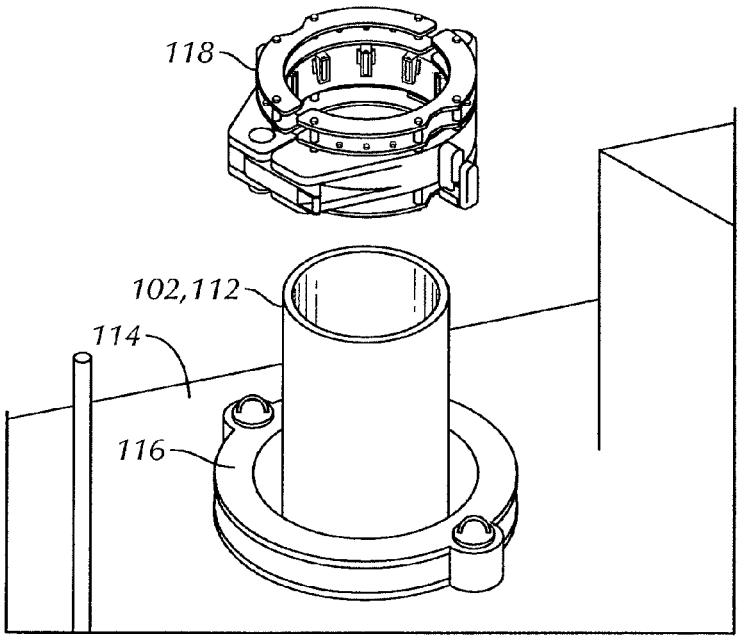
FIG. 6 is a schematic view drawing of an elevator of FIGS. 2-5 being removed from the string of conductor pipe in accordance with embodiments of the present disclosure.

Referring now to FIG. 5, conductor pipe string 112 may be engaged into the formation surrounding the wellbore (e.g., through driving, suction, jetting, etc.) from its full height (FIG. 4) to it's new, lowered height such that upper end of joint 102 of conductor string 112 is adjacent and above rig floor 114. In this new position, the slips of spider 116 may be re-engaged so that spider 116 again holds the entire weight of string of conductor pipe 112. Referring briefly now to FIG. 6, the slips of elevator 118 may be de-activated so that elevator 118 may be lifted, e.g., by the rig's draw works, and removed from upper end of added on joint 102 of conductor string 112 so that the process may be repeated with a new joint of conductor pipe to be added.

Figure 7:
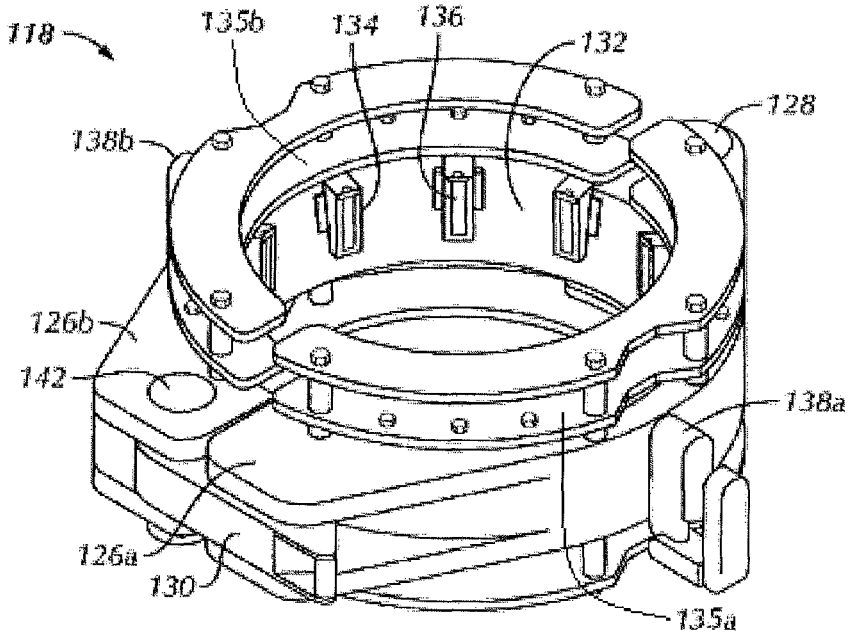
FIG. 7 is a detailed perspective view drawing of the elevator of FIGS. 2-6 in accordance with embodiments of the present disclosure.

Referring now to FIG. 7, a more detailed view of the elevator 118 depicted in FIGS. 2-6 is shown. Elevator 118 is shown constructed as a segmented ring comprising a first half 126A, a second half 126B, a hinge, 128, and a latch 130. Latch 130 may be constructed as a pin, a hinge, or any other mechanism through which a connection between half 126A and half 126B may be coupled and de-coupled. While elevator 118 is shown segmented into two halves 126A, 126B, those having ordinary skill will appreciate that more than two segments may be used. Furthermore, it should be understood that the segments of elevator 118 need not be equal in size or angle swept. For example, in one embodiment, segmented elevator 118 may comprise three segments, two segments having 150° swept angles, and a third (e.g., non-pivoting) segment having an angle of 60°.

Furthermore, when in the closed position (shown), the inner profile 132 of the halves 126A, 126B of the segmented ring is generally circular in shape and includes a plurality of slip assemblies 134 spaced at generally equal radial positions (at a common axial location) thereabout. As shown, each slip assembly 134 includes a die, e.g., gripping surface, 136 configured to "bite" into contact with joints of conductor pipe (e.g., 102) and assembled conductor pipe string 112. Those having ordinary skill in the art will appreciate that slip assemblies 134 may be designed on inclined planes such that the grip diameter (i.e., the average inner diameter among the slip assemblies 134) of the slip assemblies 134 decreases as the slip assemblies are thrust downward. In one embodiment, a single timing ring including a first timing ring segment 135A and a second timing ring segment 135B axially actuates all slip assemblies 134 simultaneously so that the grip diameter of the elevator 118 is relatively consistent. The timing ring may be thrust hydraulically, pneumatically, mechanically, or through any type of actuator known to those having ordinary skill in the art. Thus, as slip assemblies 134 (and dies 136) are activated to engage the outer profile of conductor pipe string 112, additional downward thrusting of the conductor string 112 (e.g., from the weight of the string 112) acts to increase the amount of "bite" dies 136 exhibit into conductor pipe string 112. Those having ordinary skill in the art will appreciate that slip assemblies 134 of elevator 118 may be activated and actuated using various methods and mechanisms available including, but not limited to, electrical activation.

Figure 8A:
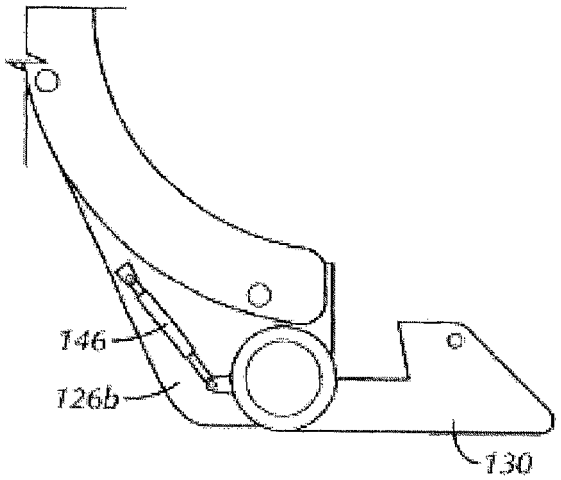
FIG. 8A is a schematic view of a first embodiment of an actuated latch mechanism of the elevator of FIG. 8.
Figure 8B:
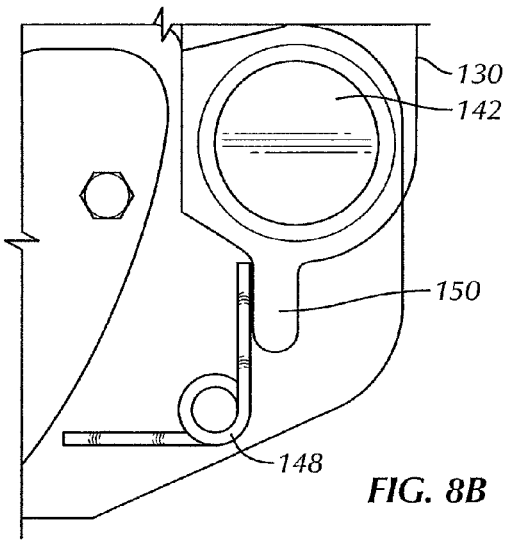
FIG. 8B is a schematic view of a second embodiment of an actuated latch mechanism of the elevator of FIG. 8.
Figure 8:
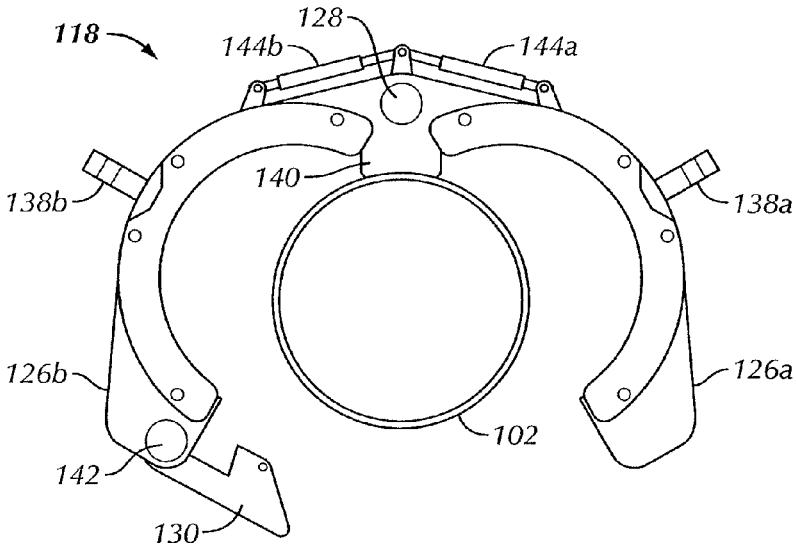
FIG. 8 is a schematic view of the elevator of FIG. 7 in an open position about to engage a joint of conductor pipe in accordance with embodiments of the present disclosure.
Figure 11:
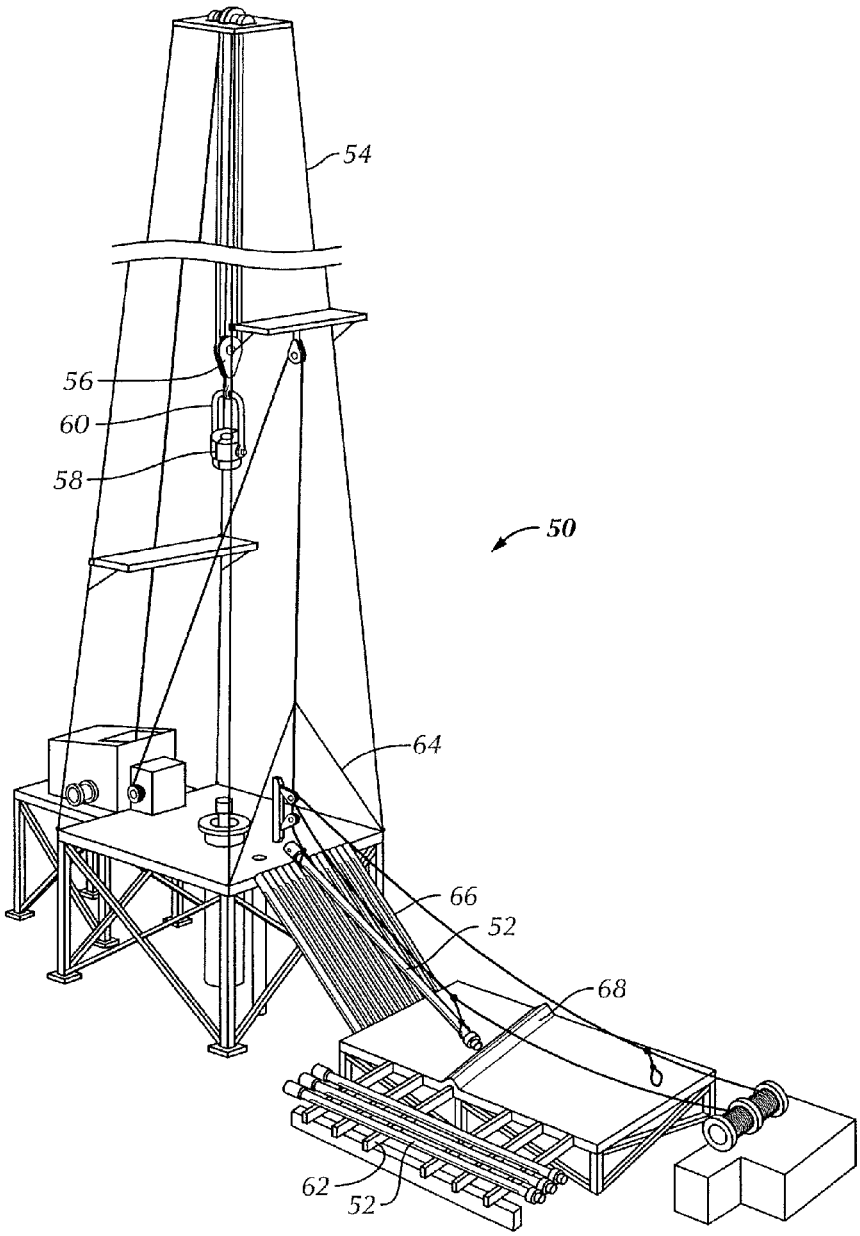
FIG. 11 PRIOR ART
FIG. 11 is a prior-art schematic drawing of a typical drilling rig.

Referring now to FIG. 8, elevator 118 is shown in an open position as it is lowered over a horizontally-laying joint of conductor pipe 102. A lifting sling (not shown) or an alternative form of rigging may attach to elevator at lifting lugs 138A and 138B. Such a lifting apparatus may include swivels or other devices so that elevator 118 may switch from vertical position (e.g., FIGS. 3 and 4) to horizontal position (FIG. 8) with relative ease. In certain embodiments, elevator 118 may be suspended directly from the hook (e.g., 60 of FIG. 11) of a traveling block (e.g., 56 of FIG. 11) of the rig's draw works. As shown, elevator 118 is lowered about horizontal joint of conductor pipe 102 such that a back stop 140 of elevator abuts the top of joint of conductor pipe 102. Optionally, a pair of cylinders 144A, 144B may be used to open and close halves 126A, 126B of elevator 118. Similarly, referring briefly to FIG. 8A, a cylinder 146 may be used to open and close latch 130 between halves 126B and 126A. While hydraulic cylinders are depicted in FIGS. 8 and 8A as 144A, 144B, and 146, it should be understood that pneumatic cylinders, mechanical ball screws, or any other type of powered actuator may be used. Alternatively still, referring to FIG. 8B, a torsion spring 148 in conjunction with an upset portion 150 of latch 130 may be used to bias latch 130 in a closed or open direction.

Figure 9:
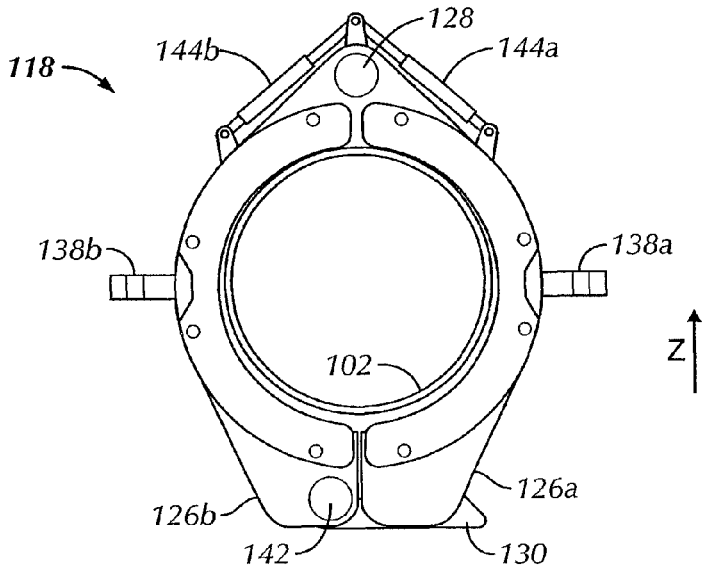
FIG. 9 is a schematic view of the elevator of FIG. 8 in a closed position around the joint of conductor pipe in accordance with embodiments of the present disclosure.

Referring now to FIG. 9, the two halves 126A, 126B of elevator 118 may rotate about hinge 128 to the closed position and latch 130 may rotate about pin 142 to lockably engage half 126B with half 126A. Because joint of conductor pipe 102 is non-vertical and elevated (e.g., with lifting apparatus 100 of FIG. 1), two halves 126A, 126B of elevator 118 may rotate about hinge 128 to the closed position, e.g., encircling the joint 102. Depicted latch 130 has sufficient clearance to reach around the bottom of joint of conductor pipe 102 and engage with half 126A of segmented ring of elevator 118. With latch 130 secured closed, elevator may be lifted up (in direction Z) without concern that halves 126A, 126B will separate and release joint of conductor pipe 102. As such, slips 134 may be activated to secure (and center) joint of conductor pipe 102 within the inner profile of elevator 118. In alternative embodiments, latch 130 may function without pivot pin 142 and may have a lower profile. It should be understood that embodiments disclosed herein should not be limited to a particular latch mechanism. Furthermore, it should be understood that latch mechanism (e.g., 130) may not be necessary at all, for example, powered actuators used to open and close halves 126A, 126B of elevator 118 may be used to keep halves 126A, 126B together when lifting joint of conductor pipe 102.

Figure 10:
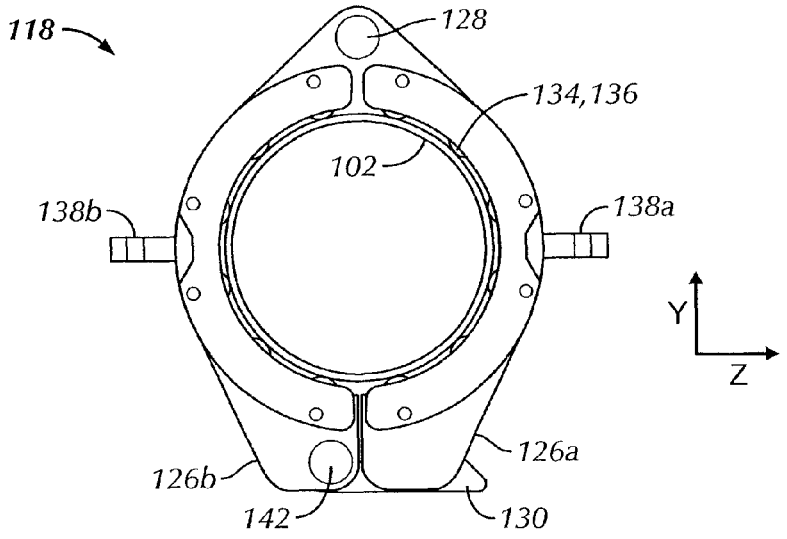
FIG. 10 is a schematic view of the elevator of FIG. 9 in a closed position with slips engaged into the joint of conductor pipe in accordance with embodiments of the present disclosure.

Referring now to FIG. 10, a top-view schematic of elevator 118 is shown with slips 134 activated into the engaged position and securing joint of conductor pipe 102 within the inner profile of segmented ring elevator 118. As such, elevator may be used to raise and lower the joint of conductor pipe 102 in the vertical position, the horizontal position, and all positions in-between.

Advantageously, embodiments disclosed herein allow an elevator to engage and lift a (e.g., horizontally laying) joint of conductor pipe without requiring the elevator to be slid over a free end of the joint of conductor pipe. Furthermore, embodiments disclosed herein depict a method by which joints of conductor pipe may be assembled and thrust into the wellbore without the need for welded and/or bolted lifting eyes to be installed and removed from each joint of conductor pipe. Pursuant thereto, embodiments disclosed herein reduce likelihood that individual joints of conductor pipe may become damaged during assembly and installation processes. Advantageously still, embodiments disclosed herein allow cylindrical joints of conductor pipe having no lifting features, e.g., upsets on the outer diameter of the pipe) to be lifted from a non-vertical position in a pipe rack or another rig location, grasped by a lifting elevator, rotated into a vertical position, and installed atop a string of conductor pipe.

While the disclosure has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

What is claimed is:

1. A lifting elevator to receive and lift a joint of pipe having no shoulder or lifting features and an outer diameter between about 20 inches and 72 inches, the elevator comprising:

a first elevator segment having a first timing ring segment and a first plurality of slips;

a second elevator segment having a second timing ring segment and a second plurality of slips;

a hinge about which both the first elevator segment and the second elevator segment are rotatable with respect to each other such that the first and second elevator segments are movable between an open position and a closed position; and a powered actuator assembly to move and retain the first elevator segment and the second elevator segment about the hinge between the open position and the closed position, wherein the elevator is configured to laterally receive the joint of pipe between the first and second elevator segments when in the open position and the joint of pipe is disposed in a non-vertical position, wherein the powered actuator assembly is configured to close the first and second elevator segments about the hinge and around the joint of pipe such that the first and second elevator segments comprise a swept angle of about 360° when in the closed position, wherein the elevator is configured to grip and reorient the joint of pipe from the non-vertical position to a vertical position when the first plurality of slips and the second plurality of slips are engaged with the joint of pipe, and wherein the elevator is configured to support a string of pipe connected to an end of the joint of pipe.

2. The lifting elevator of claim 1, further comprising:

a latch pivotably connected to one of the first elevator segment and the second elevator segment, the latch to connect the first elevator segment to the second elevator segment, wherein the latch is continuously biased by a torsion spring.

3. The lifting elevator of claim 1, wherein the first timing ring segment and the second timing ring segment are configured to be actuated using one of electrical power, hydraulic power, pneumatic power, and mechanical power.

4. The lifting elevator of claim 1, further comprising:

a first lifting lug directly coupled to the first elevator segment and a second lifting lug directly coupled to the second elevator segment.

5. The lifting elevator of claim 1, wherein the powered actuator assembly comprises a first cylinder that moves the first elevator segment and a second cylinder that moves the second elevator segment.

6. A method to receive and lift a joint of pipe having no shoulder or lifting features and an outer diameter between about 20 inches and 72 inches, the method comprising:

opening a first and a second segment of a segmented ring elevator about a hinge connecting the first and second segments;

maintaining the first and second segments in an open and non-vertical position using a powered actuator assembly;

lowering the segmented-ring elevator in the open and non-vertical position over a non-vertical joint of pipe;

closing the first and second segments of the segmented-ring elevator around the non-vertical joint of pipe using the powered actuator assembly, wherein the first and second segments comprise a swept angle of about 360° when closed;

activating a plurality of slips of the segmented-ring elevator using a timing ring;

raising the joint of pipe from a non-vertical position to a vertical position using the closed activated segmented-ring elevator;

positioning the vertical joint of pipe atop a conductor string;

attaching the joint of pipe to the conductor string; and supporting the joint of pipe and the conductor string with the segmented-ring elevator.

7. The method of claim 6, further comprising:

connecting the first elevator segment to the second elevator segment using a latch, wherein the latch is continuously biased by a torsion spring.

8. The method of claim 6, wherein the first timing ring segment and the second timing ring segment are activated using one of electrical power, hydraulic power, pneumatic power, and mechanical power.

9. The method of claim 6, wherein the segmented-ring elevator further comprises:

a first lifting lug directly coupled to the first elevator segment and a second lifting lug directly coupled to the second elevator segment.

10. The method of claim 6, wherein the powered actuator assembly comprises a first cylinder coupled to the first elevator segment and a second cylinder coupled to the second elevator segment.

11. A lifting elevator, comprising:

a first elevator segment having a first plurality of slips;

a second elevator segment having a second plurality of slips;

a hinge about which both the first elevator segment and the second elevator segment are rotatable with respect to each other;

a powered actuator assembly to move and retain the first and second elevator segments about the hinge between an open and a closed position, wherein the first and second elevator segments comprise a swept angle of about 360° when in the closed position; and a latch pivotably connected to one of the first elevator segment and the second elevator segment, the latch to connect the first elevator segment to the second elevator segment, wherein the latch is continuously biased by a torsion spring, wherein each of the first plurality of slips and the second plurality of slips comprises a die configured to grip an external surface of a pipe, wherein the elevator is configured to laterally receive the joint of pipe between the first and second elevator segments when in the open position and the joint of pipe is disposed in a non-vertical position, and wherein the elevator is configured to grip and reorient the joint of pipe from the non-vertical position to a vertical position when the first plurality of slips and the second plurality of slips are engaged with the joint of pipe, wherein the first elevator segment has a first timing ring segment, and wherein the second elevator segment has a second timing ring segment.

* * * * *